United States Patent [19]

Delano

[11] Patent Number: 4,488,407

[45] Date of Patent: Dec. 18, 1984

[54] PROCESS FOR MAKING SLUSH

[75] Inventor: Mark A. Delano, White Plains, N.Y.

[73] Assignee: Union Carbide Corporation, Danbury, Conn.

[21] Appl. No.: 478,148

[22] Filed: Mar. 23, 1983

[51] Int. Cl.[3] ..... F25C 1/00

[52] U.S. Cl. ..... 62/74; 62/48

[58] Field of Search ..... 62/74, 347, 48; 239/2 S, 14, 427.3

[56] References Cited

U.S. PATENT DOCUMENTS

| | | | |
|---|---|---|---|
| 2,020,719 | 11/1935 | Bottoms | 62/74 |
| 2,968,164 | 1/1961 | Hanson | 62/74 |
| 3,068,105 | 12/1962 | Morrison | 99/136 |
| 3,762,176 | 10/1973 | Coggins, Jr. | 62/74 |
| 3,964,682 | 6/1976 | Tropeano | 239/2 S |
| 3,979,061 | 9/1976 | Kircher | 239/2 S |
| 4,004,732 | 1/1977 | Hanson | 239/2 S |
| 4,105,161 | 8/1978 | Kircher et al. | 239/2 S |
| 4,300,355 | 11/1981 | McWhorter et al. | 62/48 |
| 4,305,257 | 12/1981 | Kneeland | 62/48 |

*Primary Examiner*—William E. Tapolcai
*Attorney, Agent, or Firm*—Saul R. Bresch

[57] ABSTRACT

A process for making slush is disclosed including the steps of delivering liquid nitrogen in mid-air from a horizontal spray nozzle, and delivering a liquid to be slushed also in mid-air from a plurality of spray nozzles spaced equidistant from each other and equidistant from the horizontal nozzle delivering the liquid nitrogen.

1 Claim, 2 Drawing Figures

FIG. 1
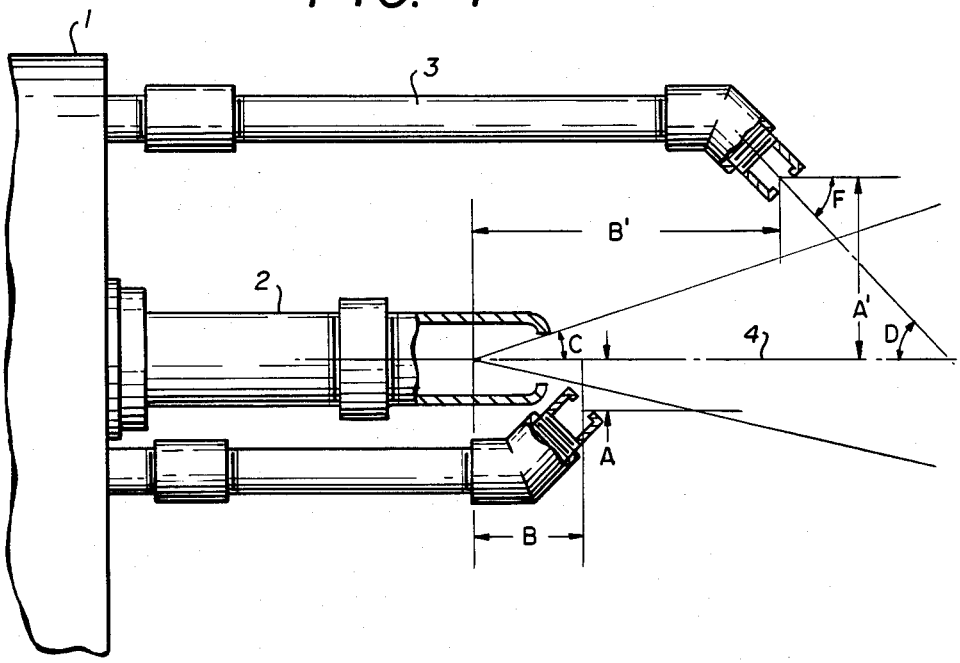
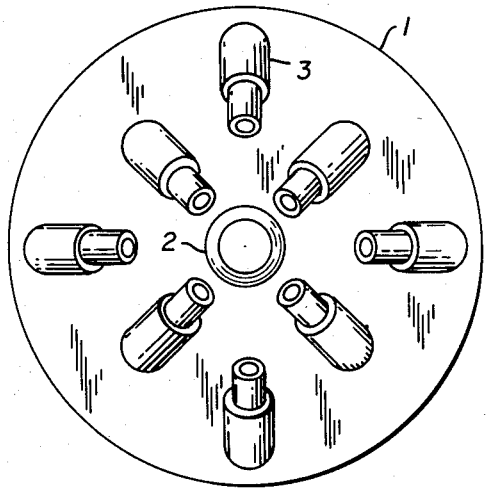
FIG. 2

PROCESS FOR MAKING SLUSH

DESCRIPTION

1. Technical Field

This invention relates to a process for making slush for use in various industrial cooling applications such as concrete mixing and the transportation of orange juice.

2. Background Art

To meet stringent temperature requirements in the production and/or transportation of certain materials such as concrete, slush has become an essential ingredient. Slush is defined in the dictionary as partly melted or watery snow. The man-made slush contemplated here, instead of starting from snow, begins with water, preferably, but not necessarily, at temperature approaching its freezing point.

Concrete is made, typically, in a horizontal batch mixer, by mixing together a cementing material such as portland cement and a mineral aggregate such as sand and gravel with sufficient water. The batch mixer combines these materials into a homogeneous mixture ready for pouring at the construction site. To prevent the concrete from setting and binding the entire mass until it has been poured, the mixer is caused to revolve continuously. In addition to its being in a pourable condition, the concrete mix is required to be below a certain temperature to assure that it sets properly, i.e., without thermal stresses.

To keep the concrete below this maximum temperature, which is usually about 80° F., on days when the ambient temperature exceeds 80° F. or even 90° F., the substitution of slush for water has been found to be advantageous, and the use of a liquid cryogen such as liquid nitrogen to turn the water into slush has been found to be quite practical.

Liquid nitrogen slushing processes, which are presently being used or proposed, have certain limitations, however. In order to obtain the ice fraction or solids concentration typically required in a slush used in cooling concrete, which fraction is in the range of about 25 to about 35 percent by weight of the slush, these processes require high flow rates. Further, they are unable to deliver the slush in the horizontal mode, and thus are not compatible with horizontal batch mixers; they also need closed conduits in which to prepare the slush; and, finally, systems using these processes are susceptible to freeze-up caused by the high flow rate in the closed conduit and are limited in their production of ice or solids to the 25 to 60 percent by weight range.

DISCLOSURE OF INVENTION

An object of this invention, therefore, is to provide an improvement in prior art slushing processes, which delivers slush on a horizontal as well as a sloping plane; procedures slush in mid-air as opposed to requiring an enclosure; and avoids freeze-up, all at low flow rates.

Other objects and advantages will become apparent hereinafter.

According to the present invention, therefore, such a process for making slush has been discovered comprising the following steps:

(a) delivering liquid cryogen at a flow rate in the range of about 15 gpm to about 250 gpm and at a pressure in the range of about 2 psig to about 50 psig, the delivery being effected in a right circular cone-shaped spray wherein the hypothetical axis of the cone is horizontal or at a downward angle of about 1 to about 90 degrees from the horizontal;

(b) delivering a liquid to be slushed in a direction co-current with the liquid cryogen at a flow rate in the range of about 0.5 to about 5 times the flow rate of the liquid cryogen and at pressure in the range of about 0.5 to about 2 times the pressure of the liquid cryogen, the delivery being effected by 1 to 5 sets of 2 to 8 right circular cone-shaped sprays per set wherein (i) the apex of each cone in a set is equidistant from the apex of each other cone in the set and from the axis referred to in step (a); (ii) the radial distance A measured from the axis referred to in step (a) to the apex of a cone in any set is in the range of about 0.5 to about 8 inches; (iii) the distance B measured along the axis referred to in step (a) from the apex of the cone referred to in step (a) to the point of intersection of a hypothetical radial line drawn from said axis to the apex of a cone in any set is in the range of about 0.5 to about 12 inches; and (iv) the value of A or B is selected for each set and the unselected value of A or B for said set is determined in accordance with step (c); and (c) determining the value of the unselected A or B for the set referred to in step (b) (iv) in accordance with the following equation:

$$A = \text{about } B \text{ times } \tan C \left\{ \sin D \left[ \left( \frac{\sin[180(1 - 1/E) - F]}{\sin F} \right)^{-1} \right]^{-1} \right\}$$

wherein:

A and B are defined as in step (b), above

C = one half of the spray angle of the spray referred to in step (a)

D = the acute angle formed by the axis referred to in step (a) and the hypothetical axis of any cone in the set E = the number of sprays selected for said set F = one half of the spray angle of any spray in said set provided, however, in the event that the value of A or B as determined by the equation is outside of the ranges therefor set forth in step (b), then, the value of A or B shall be the value set forth in step (b), which is closest to the value determined therefor by the equation.

BRIEF DESCRIPTION OF THE DRAWING

FIG. 1 is a schematic diagram of a side view of an arrangement of nozzles and sprays through which the process described herein can be effected.

FIG. 2 is a front view of an embodiment of an apparatus of which FIG. 1 is a schematic diagram. This figure shows a full complement of nozzles.

DETAILED DESCRIPTION

While any liquid cryogen can be used, liquid nitrogen is the cryogen of choice, primarily for economic reasons.

Referring to the drawing:

The drawing shows a series of pipes passing through a cylindrical chassis 1. At the end of each pipe is a nozzle. The pipes and nozzles are constructed of stainless steel. In the center of chassis 1 is pipe 2 through which the liquid nitrogen passes. Both chassis 1, if it encloses pipe 2, and pipe 2 are insulated. Pipe 2 is shown in the horizontal position in which it is usually oriented in order to drive the slush into the horizontal batch mixer. This capability, as noted, is one of the premier advantages of subject process. The liquid nitrogen is moved through pipe 2 at a flow rate in the range of about 15 gallons per minute (gpm) to about 250 gpm and preferably about 50 gpm to about 200 gpm. The pressure in pipe 2 in pounds per square inch gauge (psig) is in the range of about 2 psig to about 50 psig and preferably about 5 psig to about 15 psig. Typical nominal diameters for pipe 2 are in the range of about 0.75 to about 2.50 inches and nozzle orifice diameters are in the range of about 0.25 to about 1.25 inches.

The liquid to be slushed first passes into a manifold (not shown) and then through pipes 3 of which, in this case, there are eight, four at a distance B (the first set of nozzles) and four at a distance B′ (the second set of nozzles). B is the distance from the apex of the right circular cone-shaped spray emanating from the nozzle of pipe 2 along hypothetical axis 4 of the cone to the point of intersection of a hypothetical radial line drawn from this axis to the apex of a right circular cone-shaped spray coming from any nozzle in the first set of nozzles, i.e., the set closest to the pipe 2 nozzle. Any cone in the set can be selected for, as noted, each apex is equidistant from each other and from axis 4. The distance is designated B′ for the second set of nozzles. Distance A is referred to as a radial distance because the apexes or nozzles of pipes 3 in each set are placed as if they were points on the circumference of a circle. Of course, the intersection is at a right angle to axis 4. A distance A or B is selected or determined for each set of nozzles. In the present case, these distances are represented by A and A′ and B and B′.

The value for A is in the range of about 0.5 to about 8 inches. When the value of A is determined by the equation and the computed value is outside of the range, then the value at the extremes for the range closest to the computed value is used. This is also true for the value of B, which is kept within the range of about 0.5 to about 12 inches.

The liquid to be slushed, usually water or some other aqueous solution, is maintained at a total flow rate for all nozzles in the range of about 20 gpm to about 200 gpm and preferably about 80 gpm to about 150 gpm and at a pressure in the range of about 3 psig to about 30 psig are preferably about 8 psig to about 15 psig. The flow rate through each nozzle is determined by dividing the number of water nozzles or sprays into the total flow rate for all of the nozzles.

The water travels in the same direction as the liquid nitrogen and the water sprays are oriented in such a manner that they form an interference pattern with the liquid nitrogen spray.

There are 1 to 5 sets of water nozzles and preferably 1 to 4 sets. Within each set, there are 2 to 8 nozzles or sprays and preferably 2 to 4 sprays.

The apex of each right circular cone-shaped spray is found inside the nozzle. Since it is not practical to make measurements from the inside of the nozzle, measurements are made from the exit plane of the nozzle, i.e. from the frustum of the cone formed by bisecting the cone at the end of the nozzle. The term "about" preceding the above equation accounts for the small distance between the frustum and the apex. The adjustment is accomplished by substracting from the value for A, the quotient of the orifice diameter of a water nozzle times sin D divided by 2 tan F, and subtracting from the value for B, the quotient of the orifice diameter of the liquid nitrogen nozzle divided by 2 tan C.

As noted, C represents one half of the spray angle of the spray coming out of pipe 2. The spray angle is that angle located at the apex of the triangular plane running from the apex of the cone at a right angle to the base of the cone. F represents one half of the spray angle of the spray coming out of one of pipes 3. D is the acute angle formed by the axis of the pipe 2 spray and the axis of any pipe 3 spray. While C will remain constant for all of the sets of sprays, A, B, D, E, and F are either selected or determined for each set.

It is pointed out that the apex of each cone in a set is equidistant or equally spaced from the apex of each other cone in the set. These apexes are placed in a circle, the centerpoint of which is the axis of the spray emanating from pipe 2.

When the liquid to be slushed is sprayed, the sprays interfere with one another creating a three dimensional region of liquid. When the cryogen spray contacts the three dimensional region, the cryogen is vaporized and superheated; a portion of the liquid is frozen thus converting the liquid sprays to slush; and the resultant slush is transported as a stream by the relatively high velocity vaporized cryogen. This process may be conducted in mid-air rather than in an enclosure and is capable of producing slushes with solids concentration from as low as one percent to greater than ninety percent by weight without freeze-up. With regard to freeze-up, spraying water on the crygen spray nozzle, by accident or design, is avoided for the obvious reason, i.e., ice formation on the nozzle is not desirable.

The slush fraction generated by subject process can be approximated by the following equation:

$$G = H\frac{J/K[L + M(N - P)] - Q(R - N)}{S}$$

wherein:

$$G = \frac{\text{mass flow of frozen particles}}{\text{mass flow of liquid}} = \text{slush fraction (by weight)}$$

H = system efficiency
J = mass flowrate of cryogen
K = mass flowrate of liquid to be slushed
L = latent heat of vaporization of cryogen
M = specific heat of vaporized cryogen
N = freezing temperature of the liquid
P = boiling temperature of the cryogen
Q = specific heat of the liquid
R = temperature of the liquid at nozzle
S = latent heat of fusion of the liquid The invention is illustrated by the following example:

The apparatus and the process steps and conditions are those described above as preferred.

The process is carried out in the horizontal mode and contact between the cryogen and water takes place in mid-air, i.e., in the absence of an enclosure. Eight nozzles are used to slush 55° F. water at a flowrate of 80 gpm. A first set of four nozzles is positioned at distance A + adjustment* = 3 inches and a second set of nozzles is positioned at A′ + adjustment* = 4 inches.

The cyrogen is liquid nitrogen. The desired slush fraction is approximately 0.30, which is generally suitable for use in concrete production. The variables are adjusted to generate this fraction. 80 gpm and 8 nozzles implies that each water nozzle is to provide 10 gpm. Water nozzles are selected having the following characteristics: flow = 10 gpm at 15 psig; spray angle = 90°; and orifice diameter = 0.375 inch.

In order to determine the amount of liquid nitrogen to be used in this examle, and the cryogen nozzle size, a heat balance is performed by equating the refrigeration available in the liquid nitrogen to the refrigeration required to slush the water to an ice fraction of 0.30:

$$J[L+M(N-T)]=K[(R-N)+GS]$$

wherein the definitions of G, J, K, L, M, N, R and S are as noted above, the cryogen is liquid nitrogen, and T = the saturation temperature of liquid nitrogen.

The values are as follows:

L = 85.7 BTU's per pound
M = 0.247 BTU's per pound per °F.
N = 32° F.
T = minus 320° F.
K = 667 pounds per minute
R = 55° F.
N = 32° F.
G = 0.30
S = 143 BTU's per pound Solving for J:

J = 293 pounds per minute of liquid nitrogen.

A cryogen nozzle is selected having the following characteristics: flow = 45 gpm at 3 psig; spray angle = 65°; and orifice diameter = 1.0625 inches.

The first equation mentioned above is used to solve for B and B':

| | |
|---|---|
| A - adjustment* = 3 inches | |
| A' - adjustment* = 4 inches | |
| C = 32.5° | C = 32.5° |
| D = 45° | D' = 45° |
| E = 4 | E' = 4 |
| F = 45° | F' = 45° |

Both A and A' and B and B' are adjusted as noted above to account for the distance between the apex and the exit plane of the nozzle. Thus the adjustment is added to the 3 and 4 inches, respectively, and the sums are used in the equations as A and A'. The values of B and B' are then obtained and the appropriate adjustments are subtracted.

Therefore:

B—adjustement = 2.97 inches
B'—adjustment = 4.18 inches

Field tests show that the process is as effective in the vertical or downward sloping modes and when carried out in an enclosure.

I claim:

1. A process for making slush comprising the following steps:

(a) delivering liquid cryogen in mid-air at a flow rate in the range of about 15 gpm to about 250 gpm and at a pressure in the range of about 2 psig to about 50 psig, the delivery being effected by a right circular cone-shaped spray wherein the hypothetical axis of the cone is horizontal or at a downward angle of about 1 to about 90 degrees from the horizontal;

(b) delivering a liquid to be slushed also in mid-air in a direction co-current with the liquid cryogen at a flow rate in the range of about 0.5 to about 5 times the flow rate of the liquid cryogen and at a pressure in the range of about 0.5 to about 2 times the pressure of the liquid cryogen, the delivery being effected by 1 to 5 sets of 2 to 8 right circular cone-shaped sprays per set wherein (i) the apex of each cone in a set is equidistant from the apex of each other cone in the set and from the axis referred to in step (a); (ii) the radial distance A measured from the axis referred to in step (a) to the apex of a cone in any set is in the range of about 0.5 to about 8 inches; (iii) the distance B measured along the axis referred to in step (a) from the apex of the cone referred to in step (a) to the point of intersection of a hypothetical radial line drawn from said axis to the apex of a cone in any set is in the range of about 0.5 to about 12 inches; and (iv) the value of A or B is selected for each set and the unselected value of A or B for said set is determined in accordance with step (c); and (c) determining the value of the unselected A or B for the set referred to in step (b) (iv) in accordance with the following equation:

$$A = \text{about } B \text{ times } \tan C\left\{\sin D\left[\left(\frac{\sin[180(1-1/E)-F]}{\sin F}\right)^{-1}\right]^{+1}\right\}$$

wherein:

A and B are defined as in step (b), above
C = one half of the spray angle of the spray referred to in step (a)
D = the acute angle formed by the axis referred to in step (a) and the hypothetical axis of any cone in the set
E = the number of sprays selected for the set
F = one half of the spray angle of any spray in the set provided, however, in the event that the value of A or B as determined by the equation is outside of the ranges therefor set forth in step (b), then, the value of A or B shall be the value set forth in step (b), which is closest to the value determined therefor by the equation.

* * * * *